United States Patent [19]

Ogasawara

[11] Patent Number: 5,074,237

[45] Date of Patent: Dec. 24, 1991

[54] PAINTING APPARATUS

[75] Inventor: Toshifumi Ogasawara, Kure, Japan

[73] Assignee: Mazda Motor Corporation, Hiroshima, Japan

[21] Appl. No.: 598,773

[22] Filed: Oct. 18, 1990

Related U.S. Application Data

[63] Continuation of Ser. No. 245,159, Sep. 16, 1988, abandoned.

[30] Foreign Application Priority Data

Sep. 19, 1987 [JP] Japan ..... 62-233722

[51] Int. Cl.[5] ..... B05B 7/26; B05B 12/14

[52] U.S. Cl. ..... 118/302; 118/688; 118/692; 118/698; 239/75

[58] Field of Search ..... 118/302, 698, 688, 692; 239/112, 113, 75; 222/144.5, 55, 57, 59, 61

[56] References Cited

U.S. PATENT DOCUMENTS

| | | | |
|---|---|---|---|
| 3,348,774 | 10/1967 | Wiggins | 118/302 |
| 3,450,092 | 6/1969 | Kock | 118/302 |
| 3,831,616 | 8/1974 | Weyers | 118/688 |
| 4,246,969 | 1/1981 | McLoughlin et.al. | 222/55 |
| 4,353,482 | 10/1982 | Tomlinson et al. | 222/55 |
| 4,562,088 | 12/1985 | Navaro | 118/692 |
| 4,592,305 | 6/1986 | Scharfenberger | 118/302 |
| 4,714,179 | 12/1987 | Otterstetter et al. | 118/302 |
| 4,783,343 | 11/1988 | Sato | 118/692 |

FOREIGN PATENT DOCUMENTS 60-61076 4/1985 Japan .

*Primary Examiner*—Jay H. Woo
*Assistant Examiner*—K. P. Nguyen
*Attorney, Agent, or Firm*—Fleit, Jacobson, Cohn, Price, Holman & Stern

[57] ABSTRACT

A painting apparatus selectively sprays a plurality of different color paints by a pair spray gun at a desired discharge rate. A thinner is discharged into a pipe communicating the spray gun so as to force out a selected color paint remainiung in the pipe for continuously spraying the color paint. A flow meter is disposed in the pipe to measure the color paint flowing therethrough so as to detect its flow rate. A thinner discharge rate at which the thinner is discharged, is controlled according to the flow rate so as to spray the color paint at a substantially constant rate before and after the discharge of the thinner into the pipe.

5 Claims, 5 Drawing Sheets

PAINTING APPARATUS

This application is a continuation of application Ser. No. 07/245,159, filed Sept. 16, 1988 now abandoned.

FIELD OF THE INVENTION

The present invention relates to a painting method and an apparatus therefor in which different colors of paints are exchanged smoothly and used efficiently without waste.

BACKGROUND OF THE INVENTION

There are well known various painting methods of spraying articles or objects with different color paints by the use of a paint spray gun. Apparatuses embodying such a painting method incorporate a color paint exchanging device which exchanges paints to be sprayed from one color to another and alternately supply air and cleaning thinner to the paint spray gun.

In the painting method, after the preceding painting and before spraying another article or object with another color of paint, cleaning thinner is discharged into a pipe between the color paint exchanging device to the spray gun so as to wash off and completely remove the preceding paint remaining in the pipe and, thereafter, the another color of paint is allowed to flow into the pipe. One objective desired with such painting methods using a cleaning thinner is to keep the waste of paint small.

In an attempt at eliminating the loss of paint, disclosed in, for example, Japanese Patent Unexamined Publication No. 60-61,076 entitled "Painting Method", filed on Sept. 13, 1983 and laid open on Apr. 8, 1985, is an improved painting method in which, at a predetermined time before the completion of the preceding painting, the paint for the preceding painting is cut off and the cleaning thinner is discharged to force out the paint remaining in the pipe so as to continuously spray the paint at a same rate as before being cut off.

Describing in more detail, the process of the painting method comprises at least a preceding painting step to spray an object with a color paint, a continuous preceding painting step to continuously spray the same object with the color paint which is forced out by thinner, a cleaning step in which air and thinner are alternately repeatedly discharged to wash off the pipe between the color paint exchanging device and the spray gun, and a step to discharge another color paint and spray another object with the another color paint.

OBJECT OF THE INVENTION

It is, therefore, an object of the present invention to provide a painting method and apparatus therefor in which a cleaning thinner is discharged into a paint passage line communicating with a paint spray gun a predetermined time before the termination of spraying a paint so as to force out the paint remaining in the paint passage line and to thereby continue the spraying of the paint.

It is another object of the present invention to provide a painting method and an apparatus therefor which can save painting materials.

It is still another object of the present invention to provide a painting method and apparatus therefor which can improve the quality of painting.

SUMMARY OF THE INVENTION

A particular feature of the present invention resides in the variation of the discharge rate of thinner during the extrusion of a paint remaining in a paint passage line with the thinner according to the type of paint.

According to the present invention, the above and other object can be accomplished, in a painting method of spraying a paint by means of a paint spray gun, by discharging, at a predetermined time before the termination of thinner extrusion painting, a cleaning thinner into a pipe communicating with the paint spray gun in place of the paint at a rate varied depending on the type of the paint, in particular on the viscosity of the paint so as to force out the paint remaining in the pipe so as to continuously spray the paint.

For embodying the painting method of the present invention, the present invention provides a painting apparatus of the type selectively spraying a plurality of different color paints by means of a paint spray gun which comprises color paint exchanging means having a plurality of discharge valves which are controlled to open and close so as to selectively discharge the different color paints in the paint supply means into a pipe communicating the paint display gun; thinner discharge means having a discharge valve which is controlled to open at a predetermined time before the termination of spraying the selected color paint so as to discharge a cleaning thinner into the pipe and to thereby force out the color paint remaining in the pipe for continuously spraying the selected color paint; and control means for controlling a discharge rate at which the cleaning thinner is discharged according to the viscosity of the selected color paint so as to spray the color paint at a constant rate before and after the discharge of the cleaning thinner into the pipe.

BRIEF DESCRIPTION OF THE DRAWING

The above and other objects and features of the present invention will become apparent from the following description of preferred embodiments thereof taking reference to the accompanying drawings wherein like reference characters refer to like parts throughout the several views and in which.

DETAILED DESCRIPTION OF THE INVENTION

Figure 1:
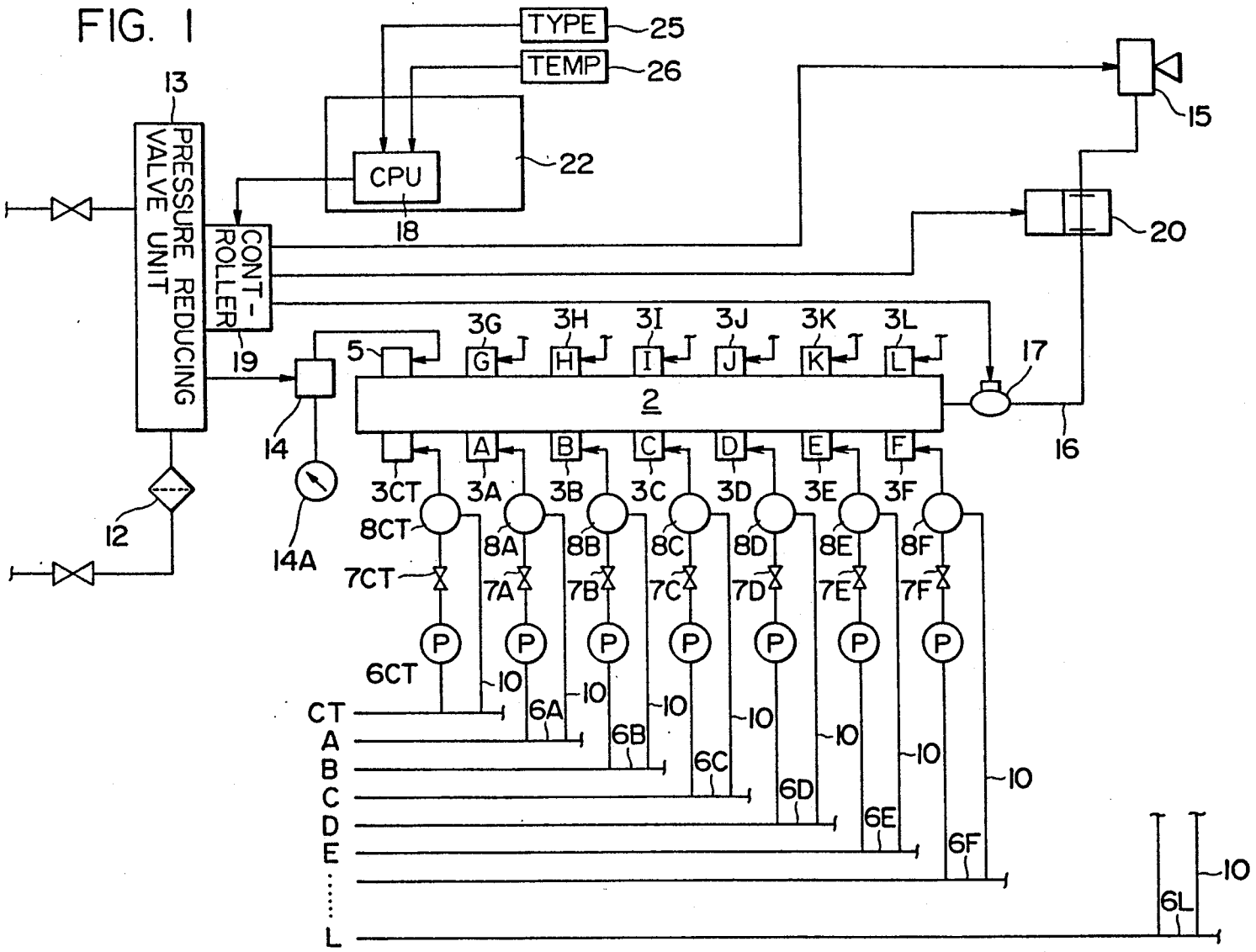
FIG. 1 is a schematic illustration showing a painting apparatus according to a preferred embodiment of the present invention.

Referring now to FIG. 1, there is schematically diagrammatically shown a painting apparatus according to a preferred embodiment of the present invention. As shown, the painting apparatus includes a color paint exchanging means such as a discharge valve assembly 1 with a manifold 2 for selectively discharging different types and/or different colors of paints. The manifold 2 has a plurality of air actuated change-over valves, namely paint discharge valves $3_A$ through $3_L$, a cleaning thinner discharge valve $3_{CT}$, and an air discharge valve 5. Connected with the manifold 2 through each paint discharge valve $3_A$–$3_L$ is a paint circulating line $6_A$–$6_L$. Paints, for example metallic paints A to F and solid paints G to L which are generally different in type and/or color from one another, are drawn up by reciprocating hydraulic pumps P provided for each paint circulating line $6_A$–$6_L$ under a constant pressure. The paints pumped up are circulated through regulators $8_A$–$8_L$ and flowover lines 10 and sent to the manifold 2 through cocks $7_A$ to $7_L$, regulators $8_A$ to $8_L$ and the paint discharge valves $3_A$ to $3_L$ when the regulators 8 are selectively opened. Openings of the regulators $8_A$–$8_L$ are determined depending the types of the paints A to L.

A cleaning thinner CT is also drawn up by a reciprocating hydraulic pump P from a circulating line $6_{CT}$ which is connected with the manifold 2 through a cock $7_{CT}$, a regulator $8_{CT}$ and the cleaning thinner discharge valve $3_{CT}$. The air discharge valve 5 is connected to a pressure-reducing valve unit 13 through an air regulator 14 with which an air pressure gauge 14A is cooperated. Air is supplied to the pressure-reducing valve unit 13 by an air compressor (not shown) through an air filter 12. The air compressor may be of any type well known in the art.

The manifold 2 is connected with a paint spray gun 15 through a paint passage line 16, preferably in the form of a flexible pipe, having an air operated regulator 17 for regulating the discharging quantity of paint or cleaning thinner CT to be sprayed through the air spray gun 15. Between the air operated regulator 17 and the paint spray gun 15 there is an air actuated valve 20 disposed in the paint passage line 16.

All the air operated regulator 17, the air actuated valve 20, the paint and cleaning thinner discharge valves $3_A$–$3_L$ and $3_{CT}$, and the air discharge valve 5 are actuated to open and close with control air provided by a controller 19 according to electric output signals from a microcomputer or central processing unit (CPU) 18. The paint spray gun 15 is fed with air from the pressure-reducing valve unit 13 through the controller 19 to make a paint mist with compressed air.

The microcomputer or central processing unit (CPU) 18 is linked to an automatic operation unit 22 for the painting apparatus. The CPU 18 carries data on discharge rates of paints which are selected according to characteristics of paint such as types of paints, for example solid and metallic, the viscosities of paints, an atmospheric temperature, and/or so forth. Based on the selected paint discharge rate, the CPU 18 determines a parameter for setting a discharge rate of thinner.

Figure 2:
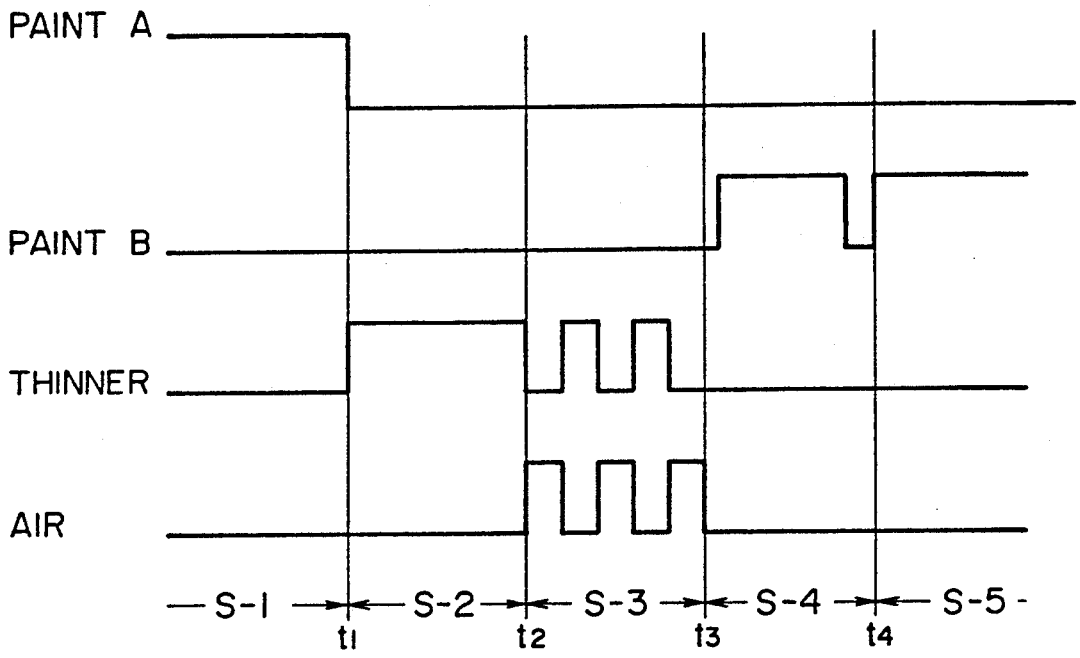
FIG. 2 is a time chart showing the process of a painting method according to a preferred embodiment of the present invention.

The painting apparatus according to the present invention is used to apply different color paintings to objects, such as car bodies, structures, structural elements and so forth, one after another. In particular, the painting apparatus is used to carry out a step-by-step process of the painting method of the present invention which includes, as is shown in FIG. 2, at least a normal painting step S-1 of painting an object with, for example, a metallic paint A, a thinner extruding painting step S-2 of painting the same object with the same paint A which is extruded with a thinner CT, a cleaning step S-3 of cleaning or washing off the manifold 2 and the flexible paint passage line 16 with pressurized air and the cleaning thinner CT which are repeatedly alternately discharged, a paint discharge step S-4 of discharging any one of the remaining paints, for example a solid paint G which is different in type and color from the paint A, into the manifold 2, and another normal painting step S-5 of painting another object with the paint G.

Operationally, the operation unit 22 opens the paint discharge valve $3_A$ first to discharge an appropriate quantity of the metallic paint A into the manifold 2 and spray it through the paint spray gun 15. At a time $t_1$ after an appropriate period of time, the operation unit 22 closes the paint discharge valve $3_A$ and, simultaneously, opens the cleaning thinner discharge valve $3_{CT}$ to discharge the cleaning thinner CT so as to extrude the paint A with the cleaning thinner CT, thereby to spray the paint metallic A remaining in the manifold 2 and/or the flexible paint passage line 16 through the paint spray gun 15. Thereafter, beginning at a time $t_2$, the CPU 18 of the operation unit 22 alternately repeatedly opens and closes the cleaning thinner discharge valve $3_{CT}$ and the air discharge valve 5 to wash off the insides of the manifold 2 and the flexible paint passage line 16. Finally, at a time $t_3$, the paint discharge valve $3_B$ is opened to discharge an appropriate quantity of the solid paint G into the manifold 2.

In the normal painting step S-1, the discharge rate of paint is varied depending upon the type of paint and an atmospheric temperature. For automatically varying the discharge rate of paint, the CPU 18 carries data on discharge parameters of paint for compensating the change of viscosity of paint due to the combination of the type of paint and temperature. An appropriate discharge rate is automatically selected by entering data on the type of paint used and an ambient temperature through input means 25 and 26, respectively. It is preferred to employ a temperature sensor for the ambient temperature input means. The temperature sensor may be of any type well known in the art and is preferably disposed in the manifold 2 or the paint passage line 16.

Figure 3:
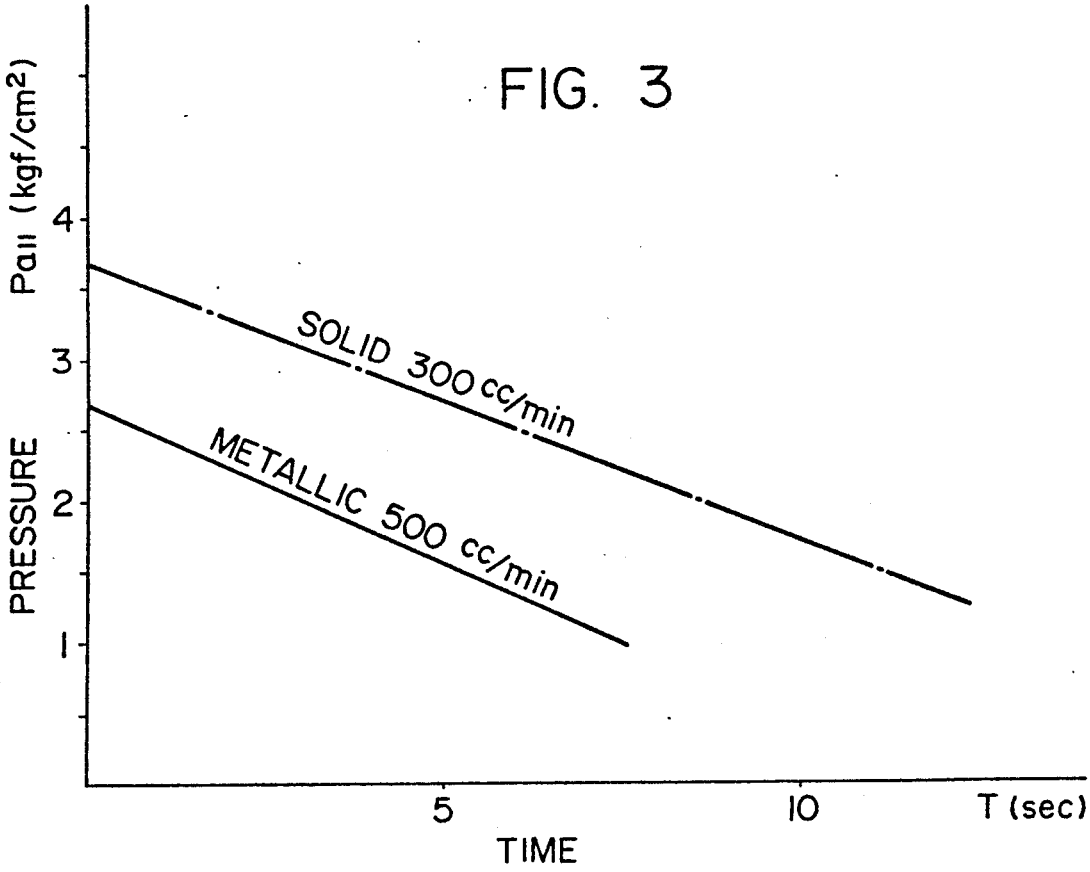
FIG. 3 is a graph showing a pressure change of a discharged thinner.

In the thinner extruding painting step S-2 beginning at the time $t_1$ and terminating at the time $t_2$ after a predetermined period of time from the time $t_1$, the discharge rate of cleaning thinner (which is defined as the volume or mass of the cleaning thinner to be discharged per unit time) at the time $t_1$ is set substantially equivalent to a rate of paint at which the metallic paint A is discharged or sprayed. Showing an example, assuming the discharge rate of paint is approximately 400 cc/min for the metallic paint A, and 500 cc/min for the metallic paint B, and 300 cc/min for the solid paint G, the thinner discharge rates are correspondingly set to equivalent values, namely 400 cc/min, 500 cc/min and 300 cc/min, respectively. Various discharge rates of thinner are previously stored in the CPU 18 as thinner discharge data. It is to be noted that not only because, with time from the time $t_1$ to the time $t_2$, the quantitative ratio of thinner relative to a residual paint remaining in the manifold 2 and the flexible paint passage line 16 gradually becomes large but because there is a difference of fluid resistance against the passage between paint and thinner, the discharged quantity of paint through the paint spray gun 15 will increasingly change with time if the discharge rate of thinner is fixed constant. This leads to an ununiform painting. For preventing such an ununiform painting, discharge parameters for compensating the thinner discharge rate are previously prepared and stored in the CPU 18 to decreasingly changes the discharge rate of thinner with time so as to maintain the discharge rate of paint constant at least between the times $t_1$ and $t_2$. The discharge rate of thinner is practically controlled by the pressure at which the thinner is discharged. For the control of the discharge rate of the thinner, the pressure at which the thinner is discharged is decreasingly changed with time. FIG. 3 shows actual examples of the change of thinner discharge pressure in the case of spraying a certain metalic paint at a rate of 500 cc/min and of spraying a certain solid paint at a rate of 300 cc/min. The CPU 18 of the operation unit 22 selects appropriate data of the thinner extrusion rate and the extrusion correction parameter according to the paint to be discharged and provides an appropriate electric signal based on the selected data. The electric signal is sent to the controller 19. The controller 19 supplies control air corresponding to the electric signal to the air operated regulator 17.

Figure 4:
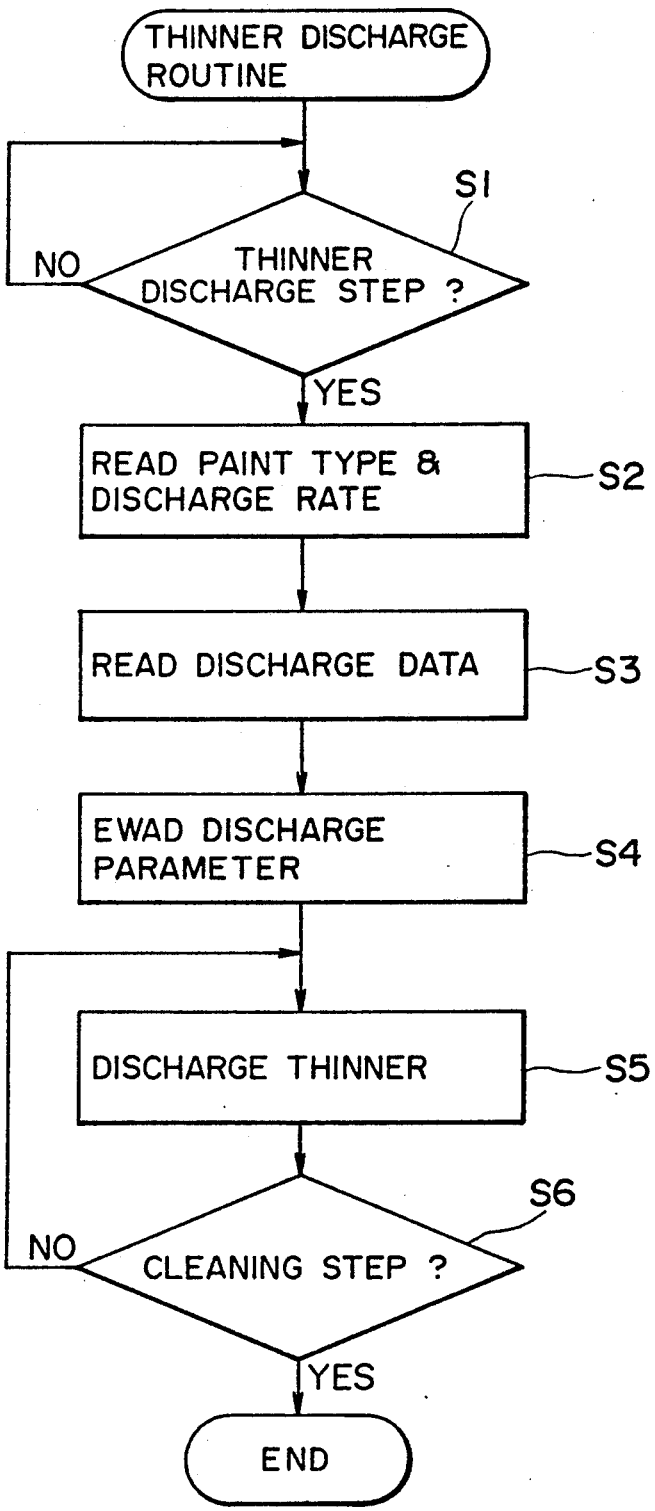
FIG. 4 is a flow chart illustrating a sequence of thinner extrusion painting step.
Figure 5:
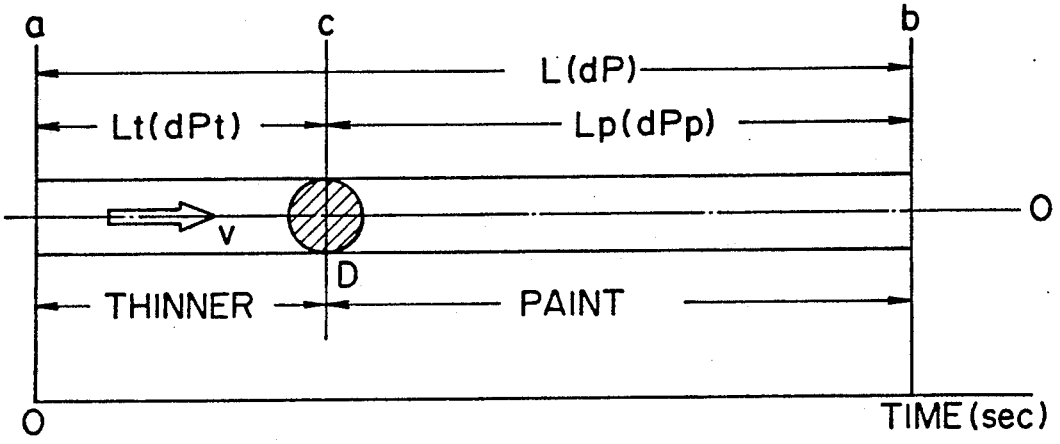
FIGS. 5 and 6 are explanatory illustrations for explaining a method of establishing thinner discharging parameters.

The operation of the painting apparatus depicted in FIG. 1 is best understood by reviewing FIG. 4, which is a flow chart illustrating a thinner discharge routine for effecting a thinner extruding painting step S-2 of the process for the CPU 18. As shown in FIG. 4, the first step S1 is to read the operating condition of the painting apparatus to decide whether the painting apparatus is in the thinner discharge step. This decision is repeatedly effected at a short time intervals. If the painting apparatus is in the thinner discharge step, the CPU 18 proceeds to the thinner extruding painting step S-2 of the painting process. The CPU 18 reads the type and discharge rate of the metallic paint A used in the preceding step, namely the normal painting step S-1 in step S2. Thereafter, the CPU 18 reads out, in step S3, the thinner discharge data according to the combination of the type and discharge rate of the metallic paint A read out in step S2 and, in step S4, a thinner discharge parameter for compensating the thinner discharge rate due to the type of paint and the temperature. Based on the data and parameter thus read out, the CPU 18 causes the controller 19 to apply control air to the air operated regulator 17 so as to discharge a regulated quantity of the thinner CT in step S5, extruding the metallic paint A remaining the manifold 2 and the paint passage line 16 to continuously spray the metallic paint A through the paint spray gun 15. After the operation of step S5, the CPU 18 makes a decision regarding the cleaning step S-3 of the process in step S6. If the answer is no, the step orders return to the preceding step S5. This decision is repeated until the yes decision is made. The yes decision orders the termination of the thinner discharge routine for the thinner extruding painting. The discharge parameters of thinner are established in such a manner as exemplarily described as follows. The paint passage line 16 shown in FIG. 5 is modelled as being scaled to a length defined between sections "a" and "b" of L (m) and an internal diameter of D (m) constant overall the length of the passage line and it is assumed that, with time T, paint and thinner run from one section "a" to the other section "b" on a lower stream of which an injection nozzle IN is provided and that the thinner is discharged at the section "a" at a time T=O and, thereafter, the interface of paint and thinner depicted by a section "c" moves at a velocity of V (m/sec). Various parameters are given as follows:

- dP: a pressure loss (kgf/m$^2$) occurring between the sections "a" and "b";
- $dP_t$: a pressure loss (kgf/m$^2$) occurring between the sections "a" and "c";
- $dP_p$: a pressure loss (kgf/m$^2$) occurring between the sections "c" and "b";
- $L_t$: a length (m) of the passage line between the sections "a" and "c";
- $L_p$: a length (m) of the passage line between the sections "c" and "b";
- Q: the mass of flow (m$^3$/sec);
- V: the velocity (m/sec) in the passage line
- D: the inner diameter (m) of the passage line
- A: the cross sectional area (m$^2$) of the supply line;
- g: the acceleration of gravity (m/sec$_2$);
- k: a constant on the friction of the supply line (which is given equivalent to, for example in this embodiment, approximately 64; and
- T: time (sec), which is equivalent to or smaller than L/V.

As physical properties of paint (p) and thinner(t), the following values are given:

- $\mu p$, $\mu t$: a viscosity (kgf/m sec) which is a function of temperature;
- $\gamma p$, $\gamma t$: a density (kg/m$^3$);
- $\gamma p$, $\gamma t$: a dynamic viscosity (m/sec);
- Rep, Ret: Reynolds number.

The conditions of flow will be assumed as follows:

(1) The flow in the supply line is a laminar flow.
(2) Paint and thinner can be dealt with as Newtonian flow.
(3) The inner surface of the supply line is a general smooth surface such as nylon, polytetrafluorethylene, steel, or stainless steel surface.

The pressure loss in the supply line is expressed as follows:

$$dPp = k\mu p(Lp/D^2)(V/2g)$$
$$dPt = k\mu t(Lt/D^2)(V/2g)$$

The lengths Lp and Lt can be expressed as functions of time as follows:

$$Lp = L - VT$$
$$Lt = V \cdot T$$

where Lp and Lt are not larger than L.

Since the length L is the total length of Lp and Lt, the pressure loss dP between the sections "a" and "b" is written $$\begin{aligned} dP &= dPp + dpt = k(1/D^2)(V/2g)(\mu p\, Lp + \mu t\, Lt) \\ &= k(1/D^2)(V/2g)[\mu p\, L + V(\mu t - \mu p)T] \end{aligned} \quad (1)$$

The relation between the mass Q and velocity V of flow is given $$Q = A \cdot V = (D^2/4) \cdot V$$

Substituting into the equation (1 , the pressure loss is rewritten $$dP = k(1/D^4)(2Q/\pi g)[\mu pL + (4Q/\pi D^2) \times (\mu t - \mu p)T] \quad (2)$$

Formula (2) represents the change of pressure loss between the sections "a"–"b" with respect to time after the provision of thinner discharge instruction.

Figure 6:
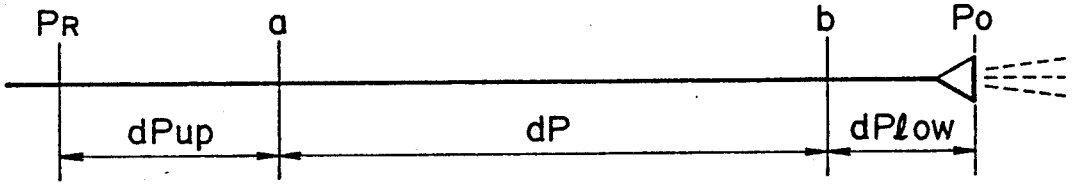

In the case of applying the above result to the painting apparatus, the relation between the pressure of the variable pressure regulator (pressure operated regulator) 17 and the equation (2) is modelled as shown in FIG. 6.

In FIG. 6, symbol $P_o$ denotes an atmospheric pressure (kgf/m$^2$); PR a pressure (kgf/m$^2$) of the regulator; $dP_{up}$ a pressure loss (kgf/m$^2$) between the section "a" and the regulator at the time the thinner injection instruction is given (no change is there according to time and no change of viscosity); $dP_{low}$ a pressure loss (kgf/m$^2$) between the section "b" and the paint spray gun at the time the thinner injection instruction is given (no change is there according to time as well as the pressure loss $dP_{up}$); and $dP_{all}$ a pressure loss (kgf/m$^2$) between the air operated regulator 17 and the paint spray gun 15 in order to obtain the required mass Q of flow).

The pressure loss needed for the rate of flow is expressed as follows:

$$dP_{all}=P_R-P_o=dP_{up}+dP_{low}+dP$$

Substituting the equation (2), the pressure loss is rewritten $$P_{all} = (dP_{up} + dP_{low}) + k(1/D^4)(2Q/\pi g) \times [\mu pL + (4Q/\pi D^2)(\mu t - \mu p)T]$$

where $dP_{up}$ and $dP_{low}$ are friction coefficients (1/m3) relative to pressure loss and are defined taking various associated elements into consideration as follows:

$$dP_{up}=k\mu tR_{up}(2Q/\pi g)$$

$$dP_{low}=k\mu pR_{low}(2Q/\pi g)$$

Hence, $$dP_{all} = k(2Q/\pi g)[\mu tR_{up} + \mu pR_{low} + 1/D^4\{\mu pL + (4Q/\pi D^2)(\mu t - \mu p)T\}] \quad (3)$$

Figure 7:
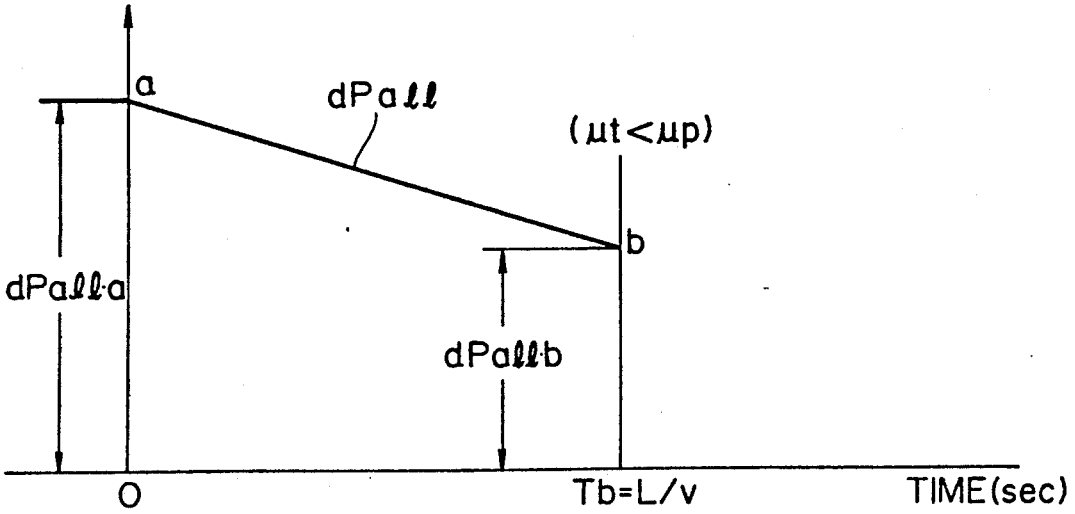
FIG. 7 is an explanatory graph showing the change of thinner discharge pressure.

The equation (3) represents the pressure change due to time needed by the air operated regulator 17 in order to maintain the quantitative rate Q of flow constant after the provision of a discharge instruction and is graphed as is shown in FIG. 7.

In FIG. 7, the pressure loss in the section "a" is obtained by substituting a value of zero for T in the equation (3) and hence $$dP_{all.a}=k(2Q/\pi g)[\mu tR_{up}+\mu p(R_{low}+L/D^4)]$$

and the pressure loss in the section "b" is obtained by substituting $T_b$ for T in the equation (8) and the time $T_b$ is written $$T_b=L/V=D^2L/4Q.$$

Hence $$dP_{all.b}=k(2Q/\pi g)[\mu t(R_{up}+L/D^4)+\mu pR_{low}]$$

As is clearly understood from the above-description, by controlling the air operated regulator 17 with the control air of which the pressure is so regulated as to vary according to the above equation between the times $t_1$ and $t_2$, the discharge rate of a paint between the times $t_1$ and $t_2$ is made substantially equal to the discharge rate at which the paint is discharged through the paint spray gun 15 before the time $t^1$. Owing to the equivalency of the discharge rate of paint throughout the normal and thinner extrusion painting steps, a high quality of painting is realized.

Figure 8:
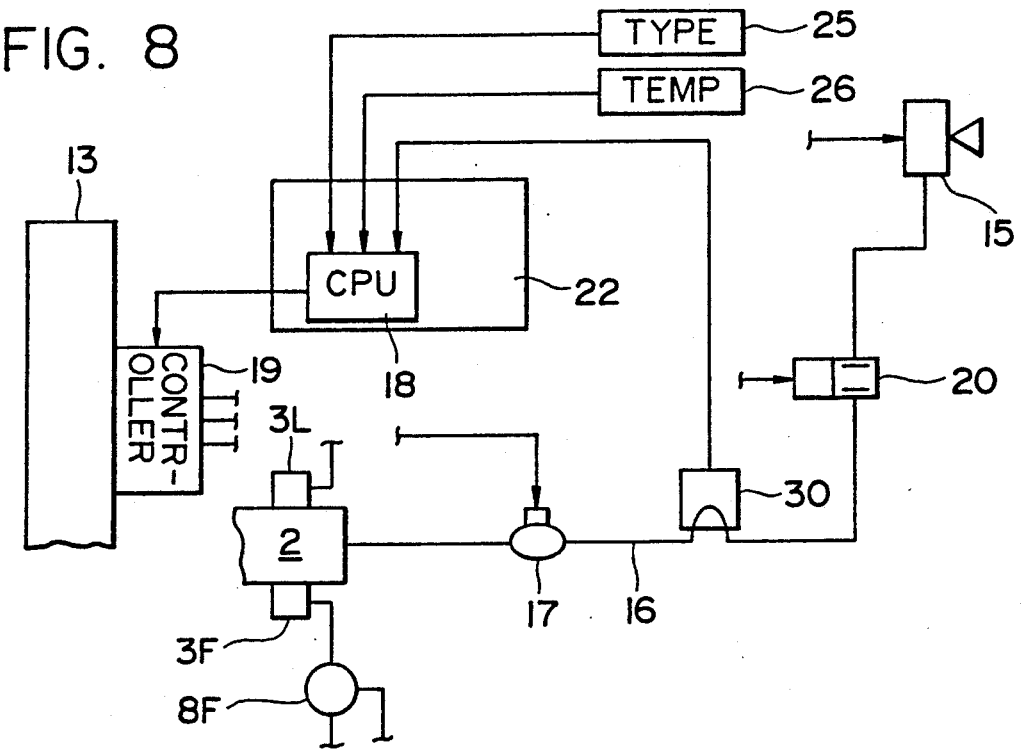
FIG. 8 is a schematic illustration showing partially a painting apparatus according to another preferred embodiment of the present invention.

Referring to FIG. 8, there is shown a painting apparatus of another preferred embodiment of the present invention which is characterized in the provision of a m ass flow meter 30 disposed between the manifold 2 of the discharge valve assembly 1 and the paint spray gun 15. In this embodiment, data on densities of various paints are previously memorized in the CPU 18. The amount of a flowing paint in mass measured by the mass flow meter 30 is transmitted to the CPU 18. The measured mass of the flowing paint is divided by the density of the paint to be converted into the volume of the flowing paint. In this way, the CPU 18 determines the discharge rate of the paint.

Figure 9:
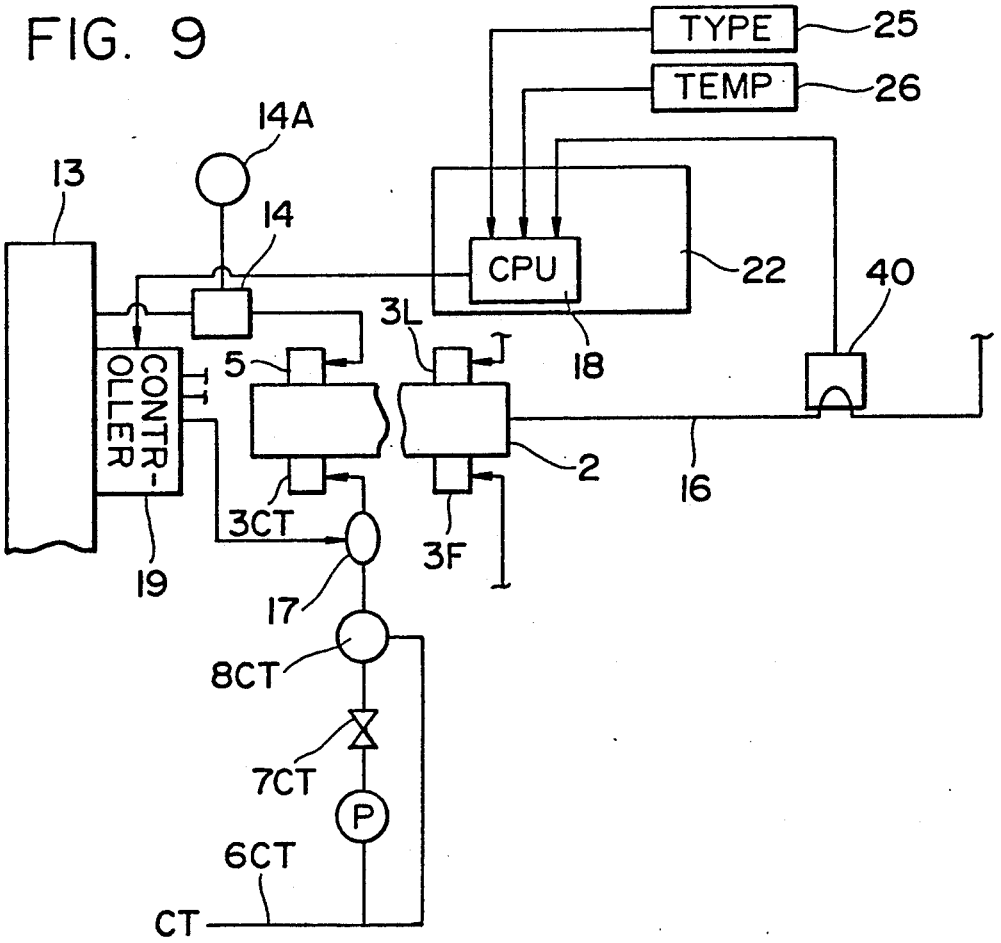
FIG. 9 is a schematic illustration showing partially a painting apparatus according to still another preferred embodiment of the present invention.

Referring to FIG. 9, there is shown a painting apparatus according to still another preferred embodiment of the present invention which is characterized in that a volumetric flow meter 40 is disposed in place of the mass flow meter 30 of the painting apparatus of FIG. 8 and that the air operated regulator 17 is disposed between the thinner discharge valve 3CT and the regulator 8CT of the thinner supply line. In this embodiment, it is not necessary to prepare the data on the densities of paints.

It is to be noted that, although the thinner extruding painting is effected continuously, it is permissible to intermittently effect the thinner extruding painting by dividing the step S-2 defined between the times t1 and t2 into a plurality of divisions. In this case, the thinner discharge pressure is varied according to the equation (3).

Although, in order to clean the inside of the manifold and the paint passage line, thinner and air are conventionally alternately repeatedly discharged three times and the discharge rate of thinner is constant in the cleaning step of any type of paint, it is, in the above-described embodiments, preferred to change cleaning or washing condition according to the types of paint. That is, thinner and air are alternately repeatedly discharged three times at a thinner discharge rate of approximately 1,000 cc/min in the cleaning of solid paints, but two times at a thinner discharge rate of approximately 800 cc/min in the cleaning of metallic paints. By way of changing the condition of cleaning according to the types of paints, the manifold and the paint passage line can be perfectly cleaned and saving of cleaning thinner is realized.

The present invention has been fully described in detail with particular reference to a preferred embodiment, but it will be understood that variations and modifications can be affected within the scope of the invention.

What is claimed is:

1. A painting apparatus for selectively spraying a plurality of different color paints from a paint spray gun, comprising:

supply means for individually supplying said plurality of different color paints or thinner to a manifold;

color paint exchanging means having a plurality of discharge valves which are controlled to open and close so as to selectively discharge at least one of said different color paints from said supply mans into said manifold;

a paint passage communicating said manifold with said paint spray gun, paint being discharged into said paint passage from said manifold during a painting step;

thinner discharge means having a thinner discharge valve which is controlled to open during an extruding step occurring before termination of spraying said at least one of said different color paints;

air discharge means having an air discharge valve which is controlled to alternately open and close as said thinner discharge valve closes and opens, respectively, to thereby force out said at least one of said different color paints from said paint passage during a cleaning step;

a regulator disposed in said paint passage for regulating the discharging quantity of paint sprayed from said spray gun;

a flow meter disposed between said regulator and paint spray gun for measuring the amount of paint flowing through said paint passage;

a central processing unit for determining a paint discharge rate according to the amount of paint measured by said flow meter; and a controller for controlling said regulator, based on a signal generated by said central processing unit, so that paint is discharged from said painting apparatus at a substantially constant rate throughout said painting and said extruding steps.

2. A painting apparatus as defined in claim 1, wherein said flow meter measures the mass of paint passing through said paint passage.

3. A painting apparatus as defined in claim 1, wherein said regulator is disposed in said paint passage between said manifold and said flow meter.

4. A painting apparatus for selectively spraying a plurality of different color paints from a paint spray gun, comprising:

supply means for individually supplying said plurality of different color paints or thinner to a manifold;

color paint exchanging means having a plurality of discharge valves which are controlled to open and close so as to selectively discharge at least one of said different color paints from said supply means into said manifold;

a paint passage communicating said manifold with said paint spray gun, paint being discharged into said paint passage from said manifold during a painting step;

thinner discharge means having a thinner discharge valve which is controlled to open during an extruding step occurring before termination of spraying said at least one of said different color paints;

air discharge means having an air discharge valve which is controlled to alternately open and close as said thinner discharge valve closes and opens, respectively, to thereby force out said at least one of said different color paints from said paint passage during a cleaning step;

a regulator, disposed between said supply means for supplying said thinner and said manifold, for regulating the discharging quantity of paint sprayed from said spray gun;

a flow meter disposed between said manifold and paint spray gun for measuring the amount of paint flowing through said paint passage;

a central processing unit for determining a paint discharge rate according to the amount of paint measured by said flow meter; and a controller for controlling said regulator, based on a signal generated by said central processing unit, so that paint is discharged from said painting apparatus at a substantially constant rate throughout said painting and said extruding steps.

5. A painting apparatus as defined in claim 4, wherein said flow meter measures the volume of paint passing through said paint passage.

* * * * *